US005772357A

United States Patent [19]

Evans

[11] Patent Number: 5,772,357

[45] Date of Patent: Jun. 30, 1998

[54] CURBING

[75] Inventor: Harold A. Evans, Swampscott, Mass.

[73] Assignee: Partners In Innovation, LLC, Manchester, N.H.

[21] Appl. No.: 556,017

[22] Filed: Nov. 9, 1995

[51] Int. Cl.[6] ..... E01F 15/02

[52] U.S. Cl. ..... 404/7; 256/13.1

[58] Field of Search ..... 47/33; 256/1, 13.1; 404/6, 7, 10

[56] References Cited

U.S. PATENT DOCUMENTS

| | | | |
|---|---|---|---|
| 4,222,197 | 9/1980 | Johnson | 47/33 |
| 4,307,973 | 12/1981 | Glaesener | 404/6 |
| 4,496,264 | 1/1985 | Casey | 404/6 |
| 5,360,286 | 11/1994 | Russell | 404/6 |
| 5,452,963 | 9/1995 | Christensen | 404/6 |
| 5,531,540 | 7/1996 | Wasserstrom et al. | 404/6 |

FOREIGN PATENT DOCUMENTS

| | | | |
|---|---|---|---|
| 811930 | 4/1938 | France | 404/7 |
| 197811 | 11/1978 | France | 404/7 |

*Primary Examiner*—James Lisehora
*Attorney, Agent, or Firm*—Cesari and McKenna, LLP

[57] ABSTRACT

A curbing system provides an outer shell constructed of a durable synthetic material. The shell has at least a base and a pair of sidewalls that extend upwardly from the base. A securing medium interconnects the base with a ground surface and a rigid filler material is contained within the enclosure defined by the base and sidewalls. The filler can be a hardenable filler that changes state from a liquid phase to a solid phase subsequent to pouring. A variety of accessories can be located on the curbing including signs, placards and color coded strips.

18 Claims, 7 Drawing Sheets

CURBING

FIELD OF THE INVENTION

This inventions relates to curbing, and more particularly, to an easily formed and installed, versatile curbing system constructed from readily available synthetic materials.

BACKGROUND OF THE INVENTION

It is desirable in constructing parking lots, roadways and walkways to utilize curbing structures. Curbing structures, typically, comprise elongated solid beams of a hard material, such as concrete, asphalt or stone. These structures have a width and height that are roughly the same, and a length that is substantially longer than the width and the height. In many applications, they are laid end-to-end, creating a continuous raised surface that serves as a guideway or barrier.

One disadvantage to conventional curbing structures and systems, is that curb sections must either be brought, intact, to a construction site or, alternatively, must be formed at the site using complex forms that are subsequently removed. In both instances, excessive time and/or energy is used to create the final curb unit. In the case of stone curbing, many steps must be employed before a final curb section is completed. Appropriate stone must be located, the stone must be quarried, usually involving substantial waste and environmental degradation and the heavy curb sections must be transported by a train or truck to the final location.

While concrete and asphalt curbing systems eliminate the quarrying steps, they must still be molded or formed before unhardened, or molten, material is applied to the molds. In this process, there is a drying time in which the forms must remain in place. This slows the construction process. In addition, there are risks inherent in both the stone curbing and poured curbing methods such that cracking or breakage of curb sections will occur during construction.

Accordingly, it is an object of this invention to provide a novel method for forming curbing and a structure for such curbing that avoids the disadvantages of the prior art. This novel structure and method should enable the formation of a durable curb with a long life, requiring minimal maintenance. The curbing should be formable into a variety of shapes, easily installed and, preferably, should enable the attachment of a variety of accessories not commonly available for existing curbing such as signage, posts and barriers.

SUMMARY OF THE INVENTION

This invention relates to a curbing system that avoids the disadvantages of the prior art by enabling a rigid outer shell to be located where desired and subsequently filled with a hardened material. Thus, forms and heavy curb members are avoided.

The curbing system includes an outer shell constructed from a durable synthetic material. The shell has at least a base and a pair of sidewalls that extend upwardly from the base. The base and sidewalls define an enclosure. A securing medium, such as an adhesive or tar, is used to interconnect the base with a ground surface. Reinforcing rods can be driven through the base into the ground in some applications.

A rigid filler material, that a preferred embodiment, comprises concrete, can be contained within the enclosure defined by the base and sidewalls. The filler material is directed into the shell as a liquid and then, subsequently, changes phase into a rigid solid. The sidewalls can define a gap through which filler can be poured along the elongated length of the shell. A cap can be provided between each of the sidewalls that is mounted after the filler is installed. At least one of the base and sidewalls can include dogs formed along the inner surface for engaging the filler material. These dogs can include undercut edges that interlock with the filler material in the manner of a dovetail.

Similar dogs can also be formed along the outer surface for mounting placards, signage or color coded strips. These optional accessories can include a base member that has corresponding edges that interlock with undercut edges of the dogs. Installation can occur by snap-fit or through use of adhesive. In the case of adhesive or other fasteners, undercut edges can be omitted.

A knock-down post can be mounted on the curbing according to this invention. The post includes a spring member that allows the post to recover to a vertical position, and a rotatable bracket that enables the post to be forced out of the vertical position into a horizontal position.

A series of shell sections can be joined, end-to-end, to form a large curbing unit that is substantially continuous. A connector section can be provided between shells. The connector can be made invisible by locating it between the inner surfaces of each of adjacent shells.

An end cap can be provided at the end of an exposed curbing shell.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
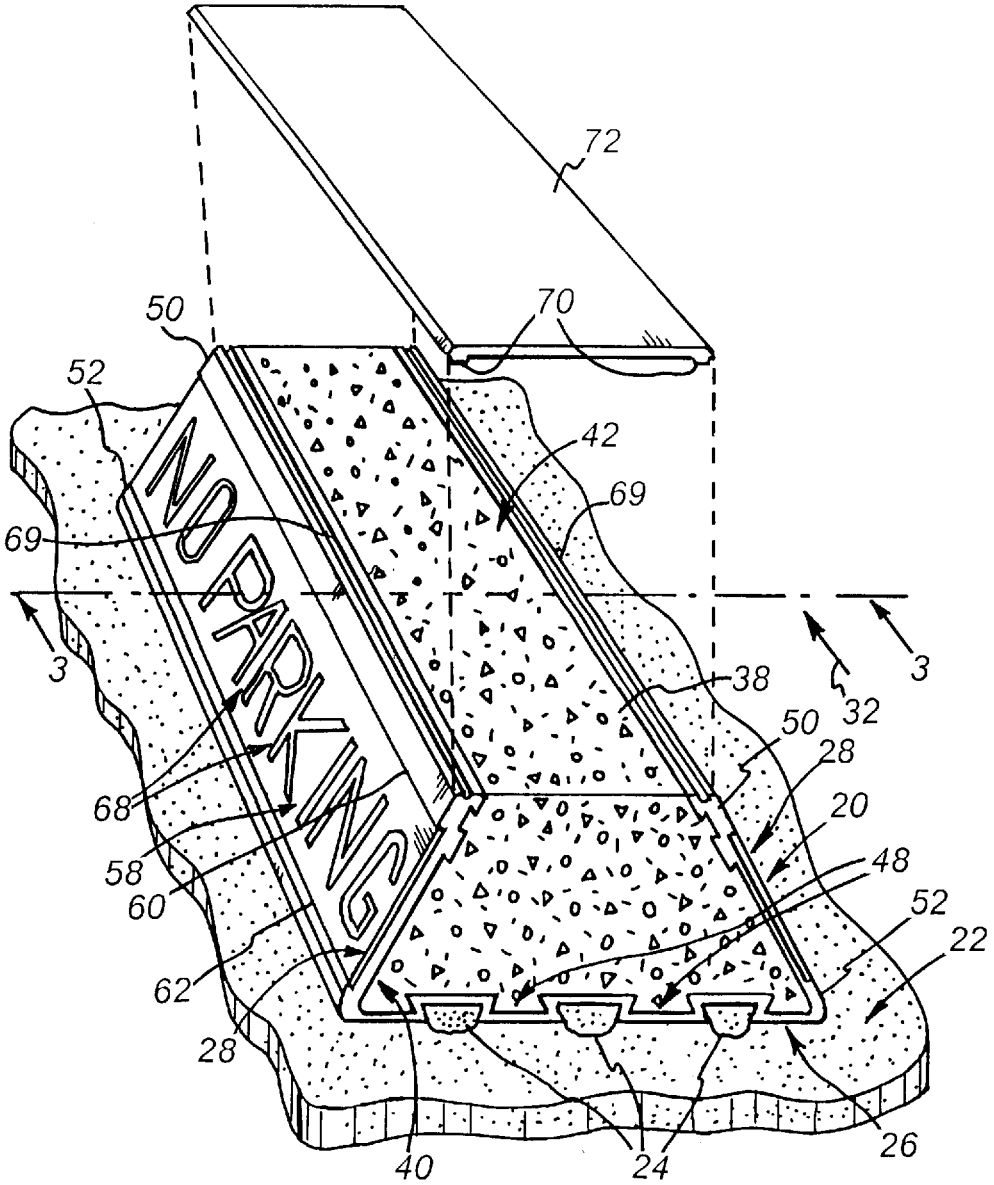
FIG. 1 is a cutaway perspective view of a curbing section according to one embodiment of this invention.
Figure 3:
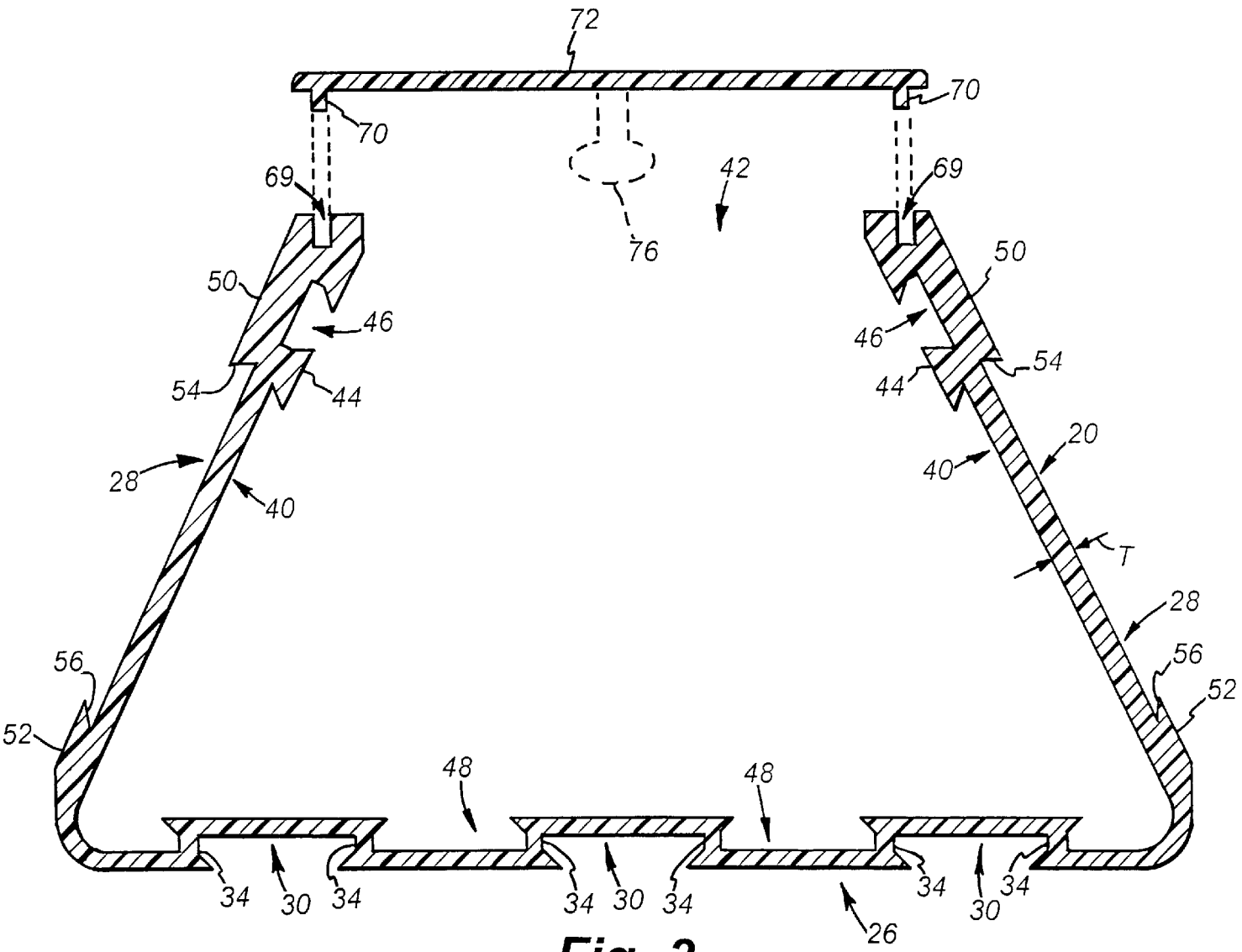
FIG. 3 is a partial cross section of the curbing section taken along lines 3—3 of FIG. 1.

FIG. 1 is a cutaway perspective view of a curbing system according to a preferred embodiment of this invention. The curbing shell 20 is secured, in this embodiment, on an asphalt subsurface 22 by an adhesive 24 that, in this embodiment, can comprise a tar, thin-set mortar or other suitable adhesive. With further reference to FIG. 3, which details the shell 20 in cross section, there is shown a generally U-shaped channel comprising a relatively flat bottom section 26 and a pair of inwardly-sloping walls 28 that, in this embodiment, are inset at equal angles and are substantially identical to each other. The shell is substantially elongated relative to its width and height. The bottom surface 26 includes a plurality of grooves 40 formed along the elongated direction (arrow 32 in FIG. 1) of the curbing 20. The grooves 30 act as cleats to further secure the curbing to the asphalt surface 22. In this embodiment, the grooves include undercuts 34 that act in the manner of a dovetail, resisting uplift of the curb once it is secured in place. Note that, according to an alternate embodiment, the curb can be seated directly into an asphalt or concrete subsurface when it is poured. In this configuration, the cleats grab into the asphalt, itself.

The shell 20, according to this embodiment, is formed as a continuous length of unitary, thin-walled, polymer. The polymer can comprise PVC, ABS or another similarly durable substance. It can be formed from new materials or, in the alternative, from recycled materials such as plastic beverage bottles and packaging.

The shell 20, according to this embodiment, can be formed by an extrusion process or another suitable molding process. The extrusion process can mimic that used in forming long lengths on pipe or house siding. It can, alternatively, be formed from flat stock bent, while soft, into a form. The average wall thickness T can vary, but is contemplated, in this embodiment, to be in a range of approximately 0.93–0.125 inch. This range, however, is only approximate and the thickness can be varied substantially, depending upon the application of the curbing system.

Curbing sections, according to this embodiment, can be formed in lengths of 20 feet or more. For curved surfaces, special forms can be constructed, in a variety of radii or, alternatively, short sections can be cut and joined with edges mitered on an angle to form a segmented curve section from straight members.

The shell 20 is filled with a rigid filler material which, in this embodiment, is poured concrete 38 (FIG. 1). The concrete, as will be described further below, can be applied by a direct pouring process or by injection under pressure. It is also contemplated that asphalt or another flowable/hardenable filler can be utilized. The top 42 of the shell 20 is open to enable insertion of a filler. The inner surface 40 of the shell 20 can include dogs 44 with recesses 46 that are formed along the direction of elongation (arrow 32). The dogs 44 and corresponding recesses 46 serve to secure the curving shell 20 to the filler, once it is hardened. The grooves 30 on the base 26 of the shell 20 also form corresponding inner grooves 48 that further secure the shell to the filler. Each of the internal grooves 46 and 48 include corresponding undercuts to prevent the shell 20 from separating from the hardened filler.

Outer dogs 50 and 52 extend along the upper and lower edges of each side 28 of the shell 20. They are equidistantly spaced from each other along the direction of elongation 32. The dogs 50 and 52 include corresponding undercut edges 54 and 56. In this embodiment, the outer dogs 50 and 52 receive a replaceable sign placard 58 that includes upper and lower edges 60 and 62, respectively, that mate with the undercut edges 54 and 56, respectively. The placard 58 can be formed from any suitable material, such as plastic or pliable metals. It can include information such as the printing 68 shown and/or can be color coded or provided with a reflective surface. As will be described further below, accessories can be located within the dogs 50 and 52. In this embodiment the dogs can be approximately ¼ inch in thickness.

In this embodiment, the upper dogs 50 include top grooves 69 that receive corresponding tabs 70 in a cap section 72. The cap section 72 according to this embodiment can comprise an extruded piece of shell material. It can be color coded or it can be the same color as the remaining shell 20. The cap pieces 72 can be provided in lengths that are similar to the length of shell section 20. The cap sections are applied so that the tabs 70 engage the slots 69. The slots and tabs can be formed so that a mating snap fit occurs using, for example, undercuts and wedges or, a conventional cement can be used to join the tabs and slots permanently. Alternatively, the top can be provided with a rail or anchor 76 (shown in phantom in FIG. 3) that mates directly with the filler 38 while it is still wet.

In some embodiments, the cap piece 72 can be omitted and a conventional or decorative top filling can be used instead.

Figure 2:
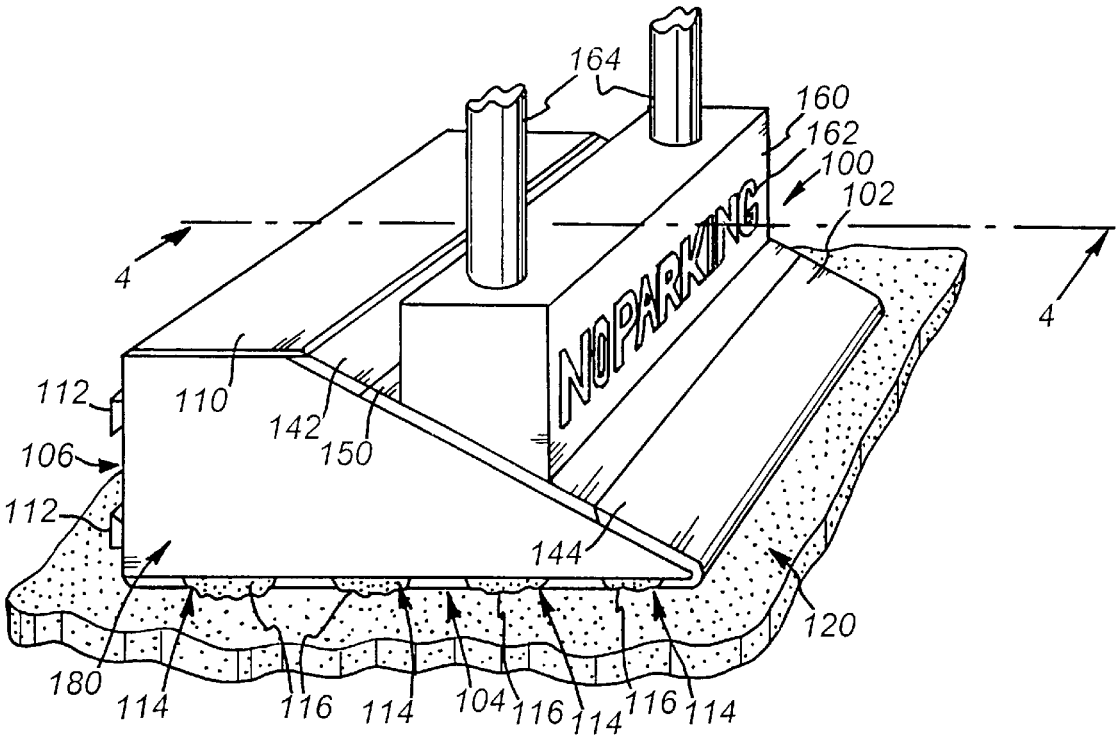
FIG. 2 is a perspective view of a curbing section according to another embodiment of this invention.
Figure 4:
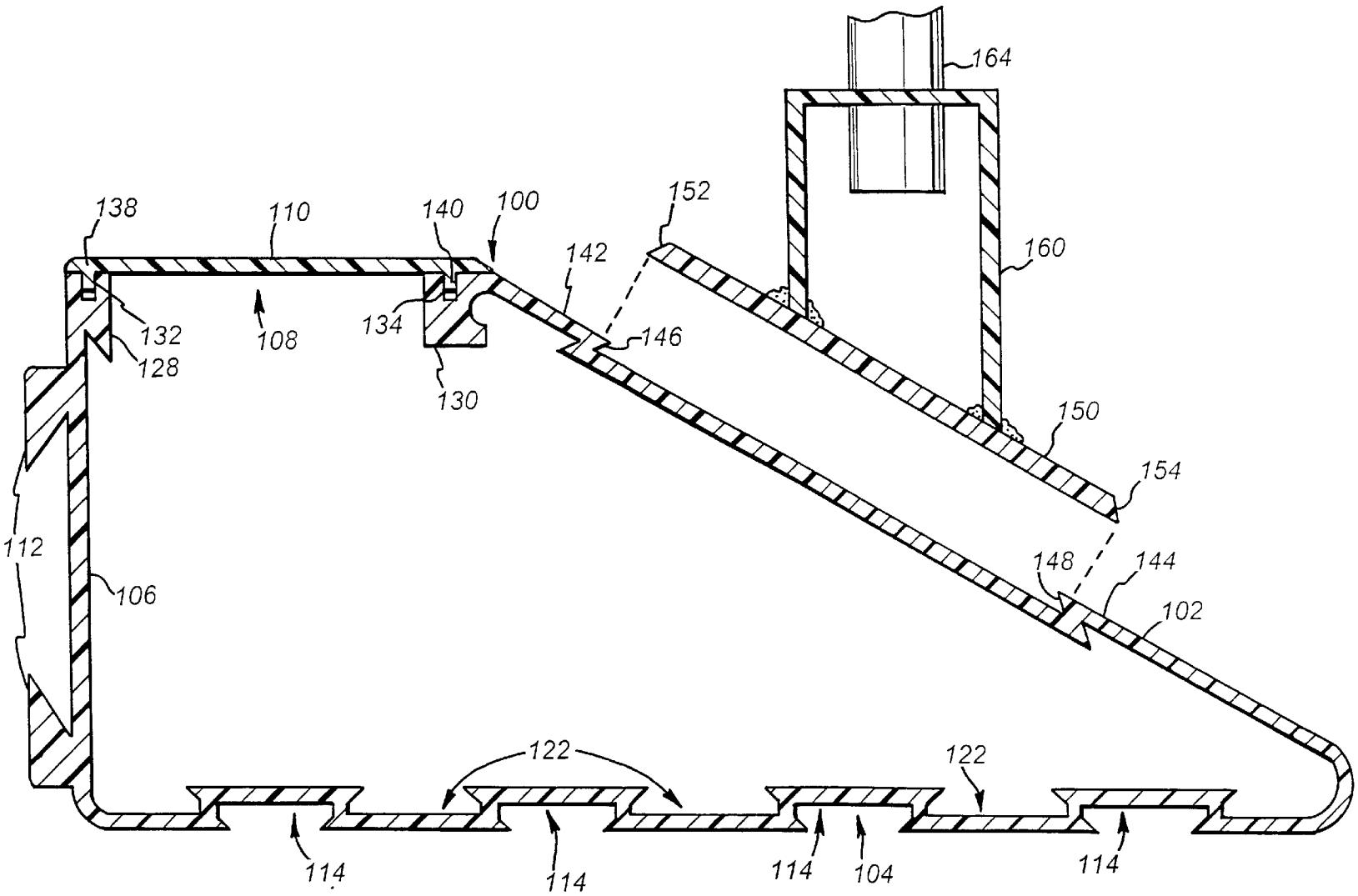
FIG. 4 is a partial cross section of the curbing section taken along lines 4—4 of FIG. 2.

An alternate embodiment of the curbing system of this invention is shown in FIGS. 2 and 4. The symmetrical curbing shell 20 of FIGS. 1 and 3 is suited to a variety of applications, such as parking lot barriers between lanes. The curbing shell 100 of FIGS. 2 and 4 is asymmetrical. That is, one side 102 of the shell 100 projects from the base 104 at an angle of approximately 30°. The opposing side 106 extends from the base 104 at an an angle of approximately 90°. The sides 102 and 104 meet at an open top section 108 that, in this embodiment, is covered by a cap section 110 that is applied similarly to the cap 72 of FIGS. 1 and 3. The curbing shell 100 of this embodiment is more generally suited to roadsides. The perpendicular side 106 forms a suitable boundary for a raised grass strip or sidewalk. In this embodiment, it includes in large, deeply undercut, dogs 112 for anchoring into soil or sidewalk concrete. The base 104 of this embodiment also includes grooves 114 designed to engage an adhesive 116 or a portion of the asphalt surface 120. The grooves 114 are undercut and form corresponding inner grooves 122 for engaging the inner filler.

A pair of upper dogs 128 and 130 include slots 132 and 134, respectively, for engaging corresponding tabs 138 and 140, respectively, of the cap section 110. The dogs 128 and 130 form part of the gripping structure that engages the hardened filler. A further pair of dogs 142 and 144 with corresponding undercut edges 146 and 148, respectively, are formed along the respective upper and lower portions of the sloped side 102. As in the embodiments of FIGS. 1 and 3, the dogs 142 and 144 receive a panel 150 with corresponding beveled edges 152 and 154. As detailed in FIG. 2, the panel is approximately the same thickness as the elevation of the dogs 142 and 144. Thus, when the panel 150 engages the dogs 142 and 144, the resulting surface appears approximately continuous between the panel and the adjacent faces of the sloped side 102. The panel 150 can include a variety of legends or signage. In this embodiment, an added feature is a raised base 160 that includes a descriptive legend 162 (FIG. 2) according to this embodiment. A further feature of this embodiment is a sign post 164 that extends from the base 160. It should be clear that the sign post can be mounted directly to the panel 150 and that the panel can, otherwise, be flat, without the raised base section 160.

The end of the curbing shell 100, in this embodiment, includes a cap 180 (FIG. 2). The cap 180 can comprise a flat member having, for example, a recessed insert (not shown) that engages the inner wall of the shell 100. It can be secured by adhesive to the shell 100 and/or can include dogs to interengage the hardened filler. The curbing according to FIGS. 1 and 3 can be provided with similar end sections according to this invention.

It is contemplated that curbing, according to this invention, can be formed with a variety of slope angles, either symmetrically or asymmetrically. The curbing can have sides that are both formed at a right angle to the base or, the sides can both be substantially sloped. The cross sectional shape of a particular curbing shell, according to this invention, can be modified to fit the particular application for which it is contemplated.

Figure 5:
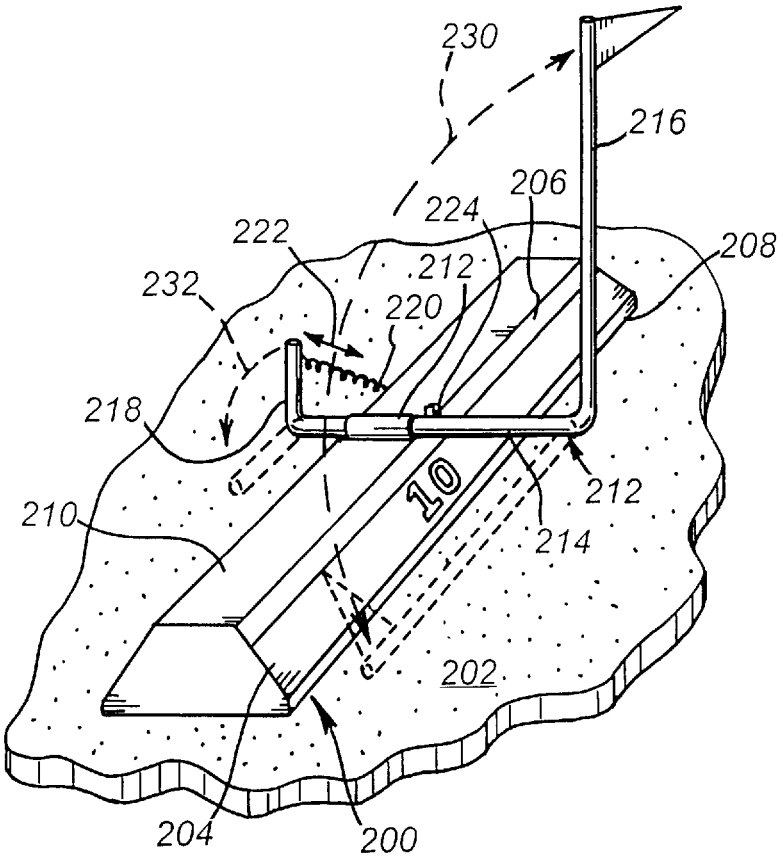
FIG. 5 is a somewhat schematic perspective view of a curbing section according to this invention including a self-recovering pole option.

FIG. 5 details another option for use with the curbing according to this invention. A completed curbing section 200 is mounted on a hard surface 202 in a manner described herein. The curbing section 200 includes a descriptive placard 204 mounted between the upper and lower dogs 206 and 208, respectively. In this embodiment, the top cap 210 includes an integral mounting bracket 212 that, this embodiment, comprises an outer tube section. Mounted rotatably within the outer tube section is an inner post 212. The inner post includes a horizontal section 214 that passes directly through the bracket 212 and an elongated sign post section 216 that extends perpendicularly upwardly to a desired height. There is a smaller lever arm section 218 attached to a tension spring 220 that is under continuous tension (double arrow 222) when the sign post 216 is in a perpendicular upright position. The tension spring can be substituted for a torsion spring according to an alternate embodiment. A metallic coil tension spring or an elastomeric spring can be utilized. Alternatively, in some embodiments, a counter weight can be used to provide the necessary rotational force to maintain the sign post 216 in an upright position. A stop 224 is provided on the horizontal post section 214. The stop 224 prevents further rotation of the post 212 in the direction of the spring's tension. The stop 224 engages the top 210 to prevent further rotation in the direction of the spring's tension. In some applications, knock-down force may occur primarily in the direction of rotation (curved arrows 230 and 232). For example, the post 216 may be oriented in knock-down in response to a vehicle traveling in a normal direction of travel along a road. The post 216 is constructed so that it can be knocked into a horizontal position (shown in phantom) so that a vehicle, mower or other conveyance can pass over without damage to either the conveyance or the post 216. According to an alternate embodiment (not shown), the lever arm 218 can include springs on both sides and the stop 224 can be omitted or, alternatively, a detent can be provided within which the post seats in an upright position. In this manner, the post can be knocked down in each of two directions. It should be clear that a torsion spring or another energy-storage device can be used instead of compression springs in this alternate embodiment. Additionally, a pivot or gimbal can be provided to enable rotation of the post along further degrees of freedom.

It is further contemplated that the bracket 212 can be provided on a support that engages the dogs 206 and 208. As such, the post assembly 212 according to this invention can be attached and removed to the curbing system where desired.

Figure 6:
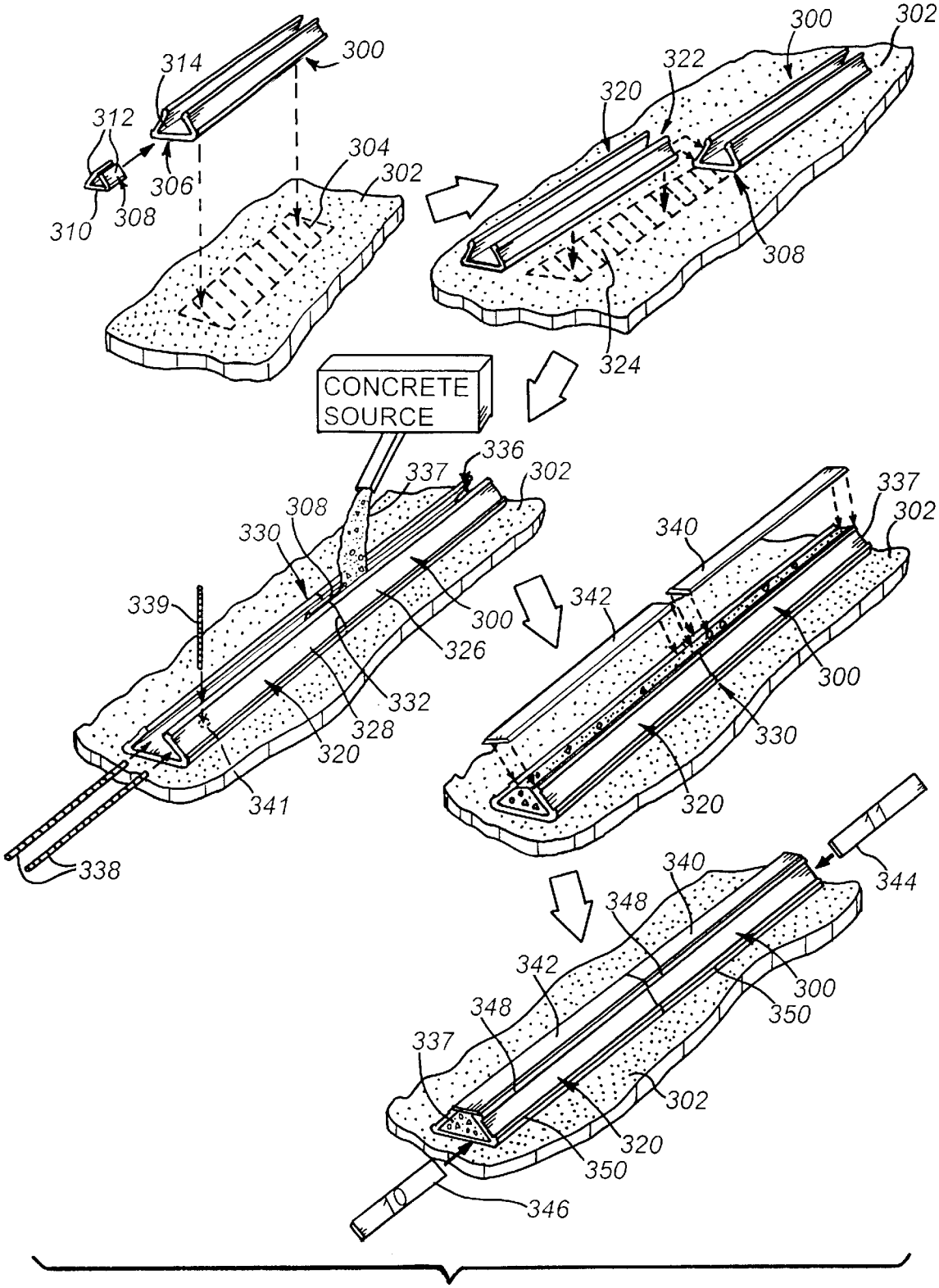
FIG. 6 is a curb-laying process according to an embodiment of this invention.

A process for constructing curbing according to this invention is detailed in FIG. 6. An outer shell of a curbing section 300 is located on a ground surface 302. In this embodiment, the ground surface 302 can comprise asphalt having an adhesive 304 laid out in an approximate outline of the base 306 of the section 300. If a multi-sectioned curbing is contemplated, a connector 308 can be utilized. The connector 308 in this embodiment comprises a channel piece having a base 310 and sidewalls 312 that is inserted into an open end 314 of the section 300. The connector can, alternatively, be formed integrally with the section 300. Additionally, externally-mounted connectors can be utilized in some embodiments. The connector can be secured by adhesive, bolts or, in some embodiments, simply left to float freely, secured permanently by the material filler as described below. Once the curb section 300 is secured to the ground surface 302, another section 320 can be positioned adjacent the original section 300. The adjoining section 320 includes an open end 322 that engages the connector 308. An extended layer of adhesive 324 can be provided for this additional section. The resulting multi-section structure 330 has sidewalls 326 and 328, respectively, that are joined at a common edge 332 in a flush face-to-face relationship. At this time, a material filler, such as concrete, can be poured through the open gap 336 formed between the sidewalls. For added strength, in some embodiments, reinforcement bars 338 can be provided before or during pouring of the concrete filler 337. Similarly, reinforcement bars 339 can be driven into the ground surface 302, projecting through holes 341 in the base 306 of the section 300 and permanently secured by the poured concrete 337. Such bars, thus, would act as spikes to secure the curbing into the ground surface 302.

While concrete is shown being poured through a gap 336 in the curbing, it is contemplated that the curbing can comprise a finished channel and concrete can be injected through an open end in the finished, totally enclosed, channel through injection under pressure.

As the concrete hardens 337, cap members 340 and 342, as described above can be secured to the top of each shell section 300 and 320. Such securing can occur by bolts, adhesive or snap-fit, among other methods. In this embodiment, a final step involves the placement of placards 344 and 346 into respective outer shell sections 300 and 320. The placards are secured within respective dogs 348 and 350 having undercut edges. It is contemplated that a variety of securing methods can be utilized. For example, placards can be slid in from the sides, as shown, or can be snap-fit directly onto the front of a sidewall, assuming that enough resilience in a placard exists to enable a snap-fit. Alternatively, non-undercut edges can be utilized and placards can be adhered or secured by screws or bolts to the curbing. Any acceptable securing technique is contemplated. While not shown, the ends of the curbing would typically be covered with end caps to prevent seepage of filler material out the ends. The resulting structure is secure, durable, versatile and easily constructed.

Figure 7:
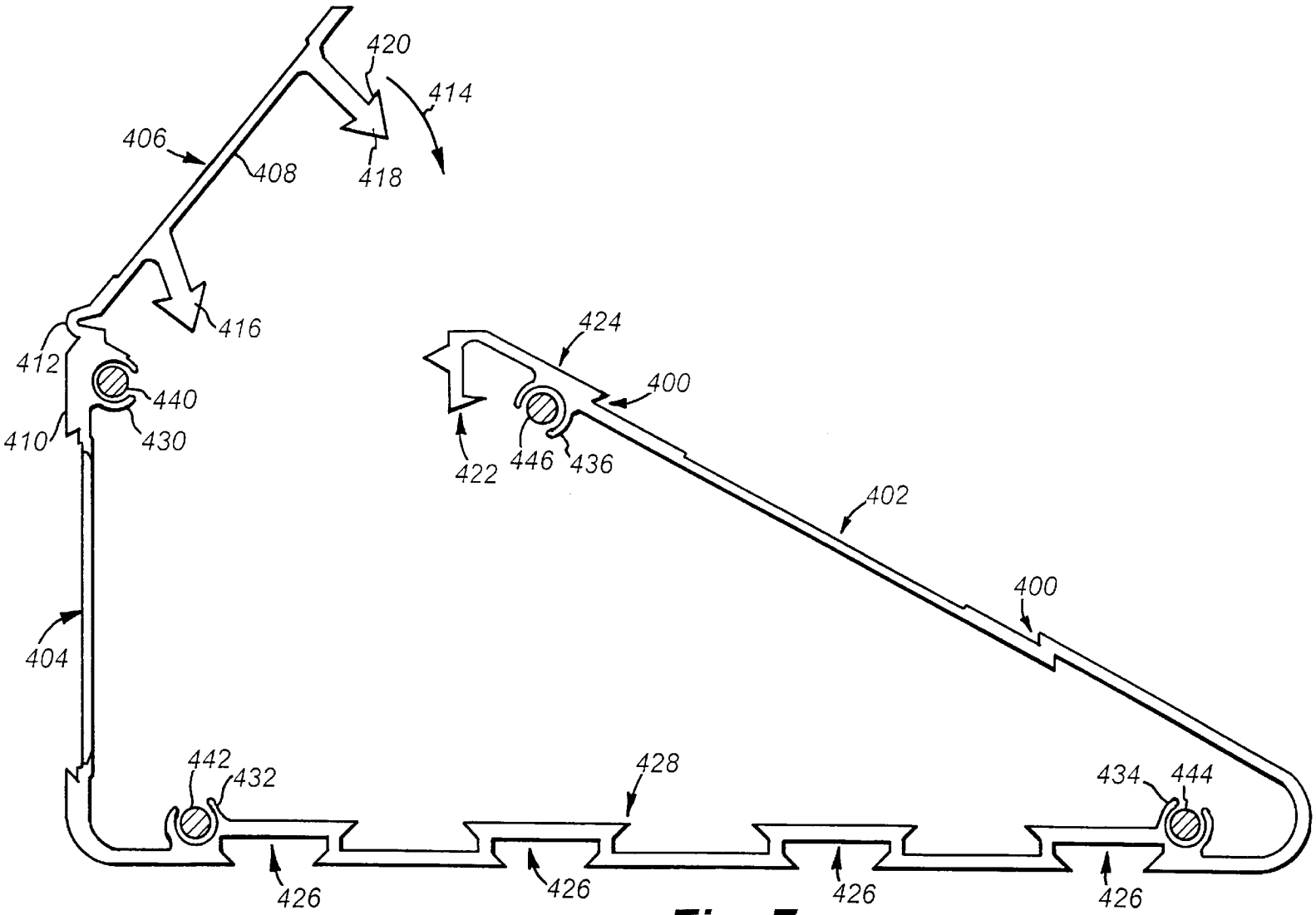
FIG. 7 is a partial cross section of the curbing section according to an embodiment of this invention.

FIG. 7 discloses yet another profile of the curbing section according to this invention. It includes undercuts 400 that define the recess 402 at the front. Similar undercuts are used to define recesses 404 and 406 on the back and top respectively. The top 408 section of the curbing is joined permanently to the rear sidewall 410 at a flexible joint 412. Since the curbing is generally formed from a resilient material, such as a polymer, the joint 412 can be flexed to open and close the top 406 (curved arrow 414) through many cycles. The top 408 includes a pair of hooked projections 416 and 418 that can embed themselves into the wet filler material (such as concrete). The hook 418 includes a barb 420 that can be sized and arranged to engage a corresponding barb 422 on the front wall or depending into the interior of the curbing section off of the front wall 424. Note that a series of grooves 426 are provided along the outer base 428 of the curbing section.

The interior walls of the curbing section also include semi-circular lugs 430, 432, 434 and 436. The lugs can extend over the full length of the curbing section or can be limited to a few inches at the ends. The lugs 430, 432, 434 and 436 are sized and arranged to receive corresponding rods 440, 442, 444 and 446, respectively, that can be constructed from polymer or metal. Bolts with end nuts can also be substituted in some embodiments and can be cinched tightly to join end sections together. It is contemplated that a pair of curbing ends are placed so that their corresponding lugs are aligned and the rods are passed from one section into another. Alternatively, alternating curbing sections can include male projecting rod ends, formed integrally with the section that are received by female lugs. The rods and/or lugs can also include snap-fit fixtures for a secure joint between sections. Where an end section of curbing, according to FIG. 7, is to be covered by an end cap, the cap can include a series of male rods, formed integrally with its structure, with or without snap-fit fixtures, to engage the female lugs.

The lugs 430, 432, 434 and 436, according to this embodiment, also serve as anchors when the curbing is filled with filler material, such as concrete. When the concrete cures, the lugs secure the sidewalls firmly to the concrete without flexure or movement. It should be noted that rods are typically inserted into the lugs prior to pouring of the filler. Likewise, the cover 406 should be secured to the top of the curbing prior to curing of the filler.

The foregoing has been a detailed description of preferred embodiments. Various modifications and additions can be made without departing from the spirit and scope of this invention. For example, while an adhesive is utilized to secure shell sections to a ground surface, the sections can be laid in place and spikes or bolts can be utilized to make a final securing. In some embodiments, the weight of the finished curbing alone may be sufficient to hold the curbing in place. Additionally, the curbing can be formed with a variety of integral structures, and in a variety of colors that can be mixed and matched where desirable. Accordingly, this description is meant to be taken only by way of example and not to otherwise limit the scope of the invention.

What is claimed is:

1. A curbing system comprising:

an outer shell constructed of a durable synthetic material comprising a U-shaped continuous channel defining a base and a pair of sidewalls that extend upwardly from the base, the base and the sidewalls constructed from a single continuous synthetic material piece and defining an enclosure that extends from the base to respective upper edges of the sidewalls;

a securing medium that interconnects the base with a ground surface;

a rigid filler material, contained within the enclosure defined by the base and the sidewalls, the filler material being a hardenable filler that changes from a liquid to a solid phase at predetermined times, the upper edges being constructed and arranged to allow location of the filler in the liquid phase into the enclosure; and wherein the U-shaped channel includes a pair of opposing ends and wherein only the rigid filler material is in contact with the sidewalls within the enclosure between the base and the upper edges at locations between each of the opposing ends.

2. The curbing system as set forth in claim 1 further comprising a cap, constructed from a durable synthetic material, the cap spanning a gap between each of the sidewalls and covering an opening formed between each of the sidewalls.

3. The curbing system as set forth in claim 1 wherein the at least one of the base and the sidewalls includes dogs formed along the inner surface for engaging the filler material.

4. The curbing system as set forth in claim 3 wherein the dogs include undercut edges.

5. The curbing system as set forth in claim 1 wherein the base includes grooves formed along an outer surface for engaging the securing medium.

6. The curbing system as set forth in claim 1 wherein the sidewalls include dogs for mounting plate members thereon, the dogs for mounting the plate members being located on outer facing faces of the sidewalls opposite the inner surface.

7. The curbing system as set forth in claim 6 wherein the dogs include undercut edges and wherein the plate members include corresponding, interengaging edges, whereby the plate members can be secured to the dogs with a snap fit.

8. The curbing system as set forth in claim 7 wherein the plate members include one of at least signage, color coding and reflective surfaces thereon.

9. The curbing system as set forth in claim 8 wherein the plate members are constructed and arranged so that they form a surface that is flush with an adjacent surface of one of the sidewalls upon which they are located.

10. The curbing system as set forth in claim 8 wherein the plate members further include raised structures that extend outwardly from the plate members.

11. The curbing system as set forth in claim 1 further comprising a bracket mounted to the outer shell and a post rotatably mounted to the bracket and extending upwardly away from the outer shell and further comprising a spring that maintains the post in an upwardly extended position, the spring being constructed and arranged so that rotation of the post relative to the bracket causes the spring to exert an opposing force on the post to urge it back into the upwardly extending position.

12. The curbing system as set forth in claim 11 further comprising a stop structure that maintains the post in a predetermined upwardly extended position.

13. The curbing system as set forth in claim 1 further comprising a connector that engages at least a portion of an inner surface of the outer shell at an open end of the outer shell constructed and arranged to tie together an adjacent open end of a similar outer shell.

14. The curbing system as set forth in claim 1 further comprising reinforcing bars located within the filler material.

15. The curbing system as set forth in claim 1 wherein the filler material comprises concrete.

16. The curbing system as set forth in claim 1 further comprising a cover flexibly joined to one of the pair of sidewalls and being movable toward and away from the other of the sidewalls to selectively expose and enclose an opening into the enclosure.

17. The curbing system as set forth in claim 16 wherein the cover includes an anchor having a shoulder and wherein one of the sidewalls includes an interengaging shoulder constructed and arranged so that the shoulder of the cover and the interengaging shoulder of the sidewall form a snap fit when the cover is placed in a closed position, covering the opening.

18. The curbing system as set forth in claim 1 further comprising a lug located along one of the sidewalls and facing into the enclosure, the lug receiving an alignment rod at the end of the sidewalls.

* * * * *